US008459163B1

(12) United States Patent
Post

(10) Patent No.: US 8,459,163 B1
(45) Date of Patent: Jun. 11, 2013

(54) ADJUSTABLE SIZING DIE ASSEMBLY

(76) Inventor: Thomas R Post, Erie, PA (US)

( * ) Notice: Subject to any disclaimer, the term of this patent is extended or adjusted under 35 U.S.C. 154(b) by 0 days.

(21) Appl. No.: 13/418,319

(22) Filed: Mar. 12, 2012

Related U.S. Application Data

(63) Continuation-in-part of application No. 12/661,961, filed on Mar. 26, 2010, now Pat. No. 8,132,348.

(51) Int. Cl.
*F42B 33/00* (2006.01)

(52) U.S. Cl.
USPC ..... 86/24

(58) Field of Classification Search
USPC ..... 86/24, 54, 57; 72/370.13
See application file for complete search history.

(56) References Cited

U.S. PATENT DOCUMENTS 125,376 A * 4/1872 Brown ..... 72/463
358,238 A * 2/1887 Wheeler ..... 86/24
464,311 A * 12/1891 Barlow ..... 86/24
903,877 A * 11/1908 Menge ..... 86/24
2,451,488 A * 10/1948 Huntington ..... 72/481.3
3,200,695 A * 8/1965 Santomieri ..... 86/1.1
3,233,304 A * 2/1966 Hettes et al. ..... 86/54
3,249,980 A * 5/1966 Miller ..... 86/54
4,462,298 A * 7/1984 Engles ..... 86/19
5,394,785 A * 3/1995 Wood ..... 86/1.1
6,412,385 B1 * 7/2002 Willis ..... 86/24
8,132,348 B1 * 3/2012 Post ..... 42/51
2005/0039595 A1 * 2/2005 Bolhassani ..... 86/19

* cited by examiner

*Primary Examiner* — Bret Hayes
(74) *Attorney, Agent, or Firm* — Richard K Thomson

(57) ABSTRACT

An action breech assembly features a one-piece action housing movable between a horizontal at rest position and a vertical cocked position to move a cocking plunger rearwardly as a result of a lateral offset between a pivot pin on which the housing is mounted and a plunger stop pin to which the plunger is attached. Pressure relief devices are provided for the powder chamber. An adjustable sizing die permits the amount of material removed from an external portion of a bullet to be adjusted to optimize the performance of the bullet in a particular rifle barrel.

3 Claims, 4 Drawing Sheets

ADJUSTABLE SIZING DIE ASSEMBLY

This application is a continuation-in-part of U.S. patent application Ser. No. 12/661,961 filed Mar. 26, 2010, now U.S. Pat. No. 8,132,348.

BACKGROUND AND SUMMARY OF THE INVENTION

The present invention is directed to the field of weaponry. More particularly, the present invention is directed to sizing die for sizing/shaping bullets for a muzzle-loaded rifle.

The present invention remedies a number of issues which have arisen regarding Applicant's earlier U.S. Pat. No. 5,722,193 issued Mar. 3, 1998. More specifically, the features of the present invention improve/simplify manufacture, operation, cleanability of the earlier mechanism as well as providing a sizing die for enhancing performance of the muzzle-loaded rifle by providing ammunition which has been sized to fit in the bore of a particular rifle barrel.

The action breech assembly of the present invention comprises a) a pivot block pinned to a barrel breech, the pivot block having fixed thereto a pivot pin and a plunger stop pin laterally offset from the pivot pin; b) a one-piece action housing including i) hook means for suspending the action housing on the pivot pin, the hook means having an opening on one side thereof; ii) a retractable thumb release assembly, the release assembly including a sliding arm partially closing the opening to maintain the one piece action housing suspended from the pivot pin; iii) a cocking plunger assembly slidably mounted in the one-piece action housing, the cocking plunger assembly having an aft action end, a hook engaged over the plunger stop pin; iv) a striker assembly reciprocally mounted in the one-piece housing, the striker assembly including $\alpha$) a generally cylindrical striker element having a forward-facing shoulder engagable by the aft action end of the cocking plunger; $\beta$) a recess extending from an aft end of the generally cylindrical striker element through a significant portion of its length; $\gamma$) a main spring assembly extending into the recess and engaging a forward surface of the recess; c) a primer adapter angulated through the pivot block for seating a primer; whereby when the one-piece action housing is rotated about the pivot pin from an at rest position to an open, cocking position, the lateral offset between the pivot pin and the plunger stop pin causes the cocking plunger assembly to move the striker assembly rearwardly and uncovers the primer adapter providing access thereto.

The breech assembly has a peripheral groove in a surface of the generally cylindrical striker element, and a pivoting sear link having a projection extending upwardly into the groove to retain the striker assembly in a cocked position. A cross bolt safety member is at least partially positionable beneath the pivoting sear link to inhibit its movement thereby preventing reciprocal movement of the striker assembly.

A trigger assembly includes a) a J-shaped trigger element; b) a pivot pin securing the trigger element to the one-piece action housing; c) a trigger force plunger engaging an upper arm of the J-shaped trigger; d) a spring exerting a downward pressure on the trigger force plunger; e) an adjustable set screw engaging an upper portion of the spring facilitating simple adjustment of the downward pressure on the trigger force plunger. A transfer pin extends between a forward end of the trigger element and a rear end of the pivoting sear link whereby when the trigger element pivots about the pivot pin, the transfer pin causes the pivoting sear link to rotate downwardly disengaging the projection from the groove allowing the main spring to propel the striker assembly forward.

The action breech assembly includes a breech plug into which the primer adapter extends, and a removable orifice seal module insertable into the barrel breech immediately downstream of the breech plug. The orifice seal module defines a first end of a powder chamber of the breech and further comprises a replaceable throat bushing at a second opposite end of the powder chamber which prevents the bullet from entering the powder chamber. The action breech assembly has over-pressure vent means for preventing damage to the barrel breech. Preferably, the over-pressure vent means includes a thin-flanged plug inserted into a wall portion of the barrel breech. Alternatively, the over-pressure vent means is a vent hole in the barrel breech and a thin wall portion of the orifice seal module which covers the vent hole.

The action breech assembly features a leaf spring attached to a rear portion of the breech assembly and extending downwardly to engage a rear portion of the one-piece action housing to retain the one-piece action housing in the at rest position. A screw head extends from the rear portion of the breech assembly, the leaf spring having a hole which receives the screw head to retain the one-piece action housing in the at rest position. An arcuate extension for finger engagement on the leaf spring for release thereof from the screw head allows the one-piece action housing to move to the open, cocked position.

The invention additionally includes an adjustable sizing die assembly for shaping a bullet, the sizing die assembly comprising a) a cylindrical steel sizing die having a first external diameter and a through bore with an internal diameter generally equivalent to an external diameter of a bullet which may be either smooth bored or the bore may include rifling grooves, the cylindrical steel sizing die having a first thin-walled tapering portion formed on a first end; b) an external sleeve having a first internal diameter equivalent to the first external diameter of the cylindrical steel sizing die and a second internal diameter larger than the first internal diameter, the second internal diameter being threaded; c) a female compression collar having a first length with a uniform internal diameter, a second length having an internal taper configured to receive the first thin-walled tapering portion, and an external thread which mates with the second internal diameter of the external sleeve; whereby when the female compression collar is tightened into the second internal diameter, the second length having the internal taper collapses the first thin-walled tapering portion to a smaller effective diameter such that when a bullet is pushed through said sizing die assembly, the bullet is swaged down to a proper diameter, size and form. The die assembly may include rifling grooves etched into the internal through bore whereby forcing the bullet through said sizing die assembly also causes the rifling grooves to be transferred to the external diameter of the bullet.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals in which.

DETAILED DESCRIPTION OF THE PREFERRED EMBODIMENT(S)

Figure 1:
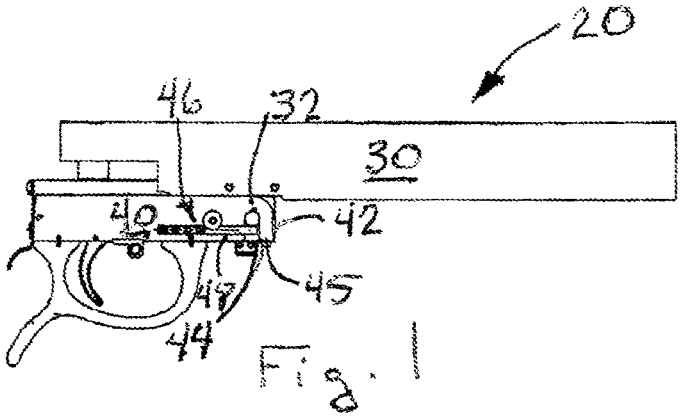
FIG. 1 is a side view of a first embodiment of the action breech assembly of the present invention.
Figure 2:
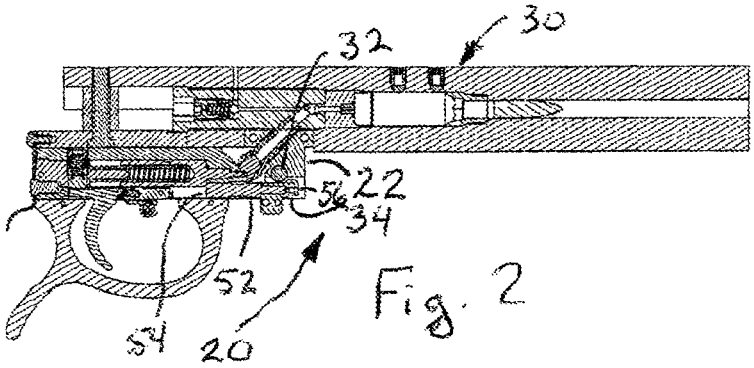
FIG. 2 is a cross-sectional side view of the first embodiment of the action breech assembly.

A first embodiment of the action breech assembly of the present invention is shown in FIGS. 1-4, 6 generally at 20. As best seen in FIG. 2, pivot block 22 is pinned to barrel breech 30. Pivot block 22 has fixed thereto pivot pin 32 and plunger stop pin 34 which is laterally offset from pivot pin 32. One-piece action housing 40 includes hook means 42 (FIG. 1) for suspending action housing 40 on pivot pin 32. Hook means 42 has opening 44 on one side 45 thereof. Retractable thumb release assembly 46, which includes sliding arm 48, partially closes opening 44 to maintain one piece action housing 40 suspended from pivot pin 32. Cocking plunger assembly 50 is slidably mounted in one-piece action housing 40 and includes cocking plunger 52 having aft action end 54 and hook 56 which engages over plunger stop pin 34. A striker assembly 60 (FIG. 4) is reciprocally mounted in one-piece housing 40 and includes a generally cylindrical striker element 62 which has a forward-facing shoulder 64 engagable by aft action end 42 of cocking plunger 52. Recess 66 extends from aft end 65 of striker element 62 through a significant portion of its length L. Recess 66 receives main spring assembly 70 which engages forward surface 67 of recess 66. Primer adapter 24 is angulated through pivot block 22 for seating a primer 11. In use, when one-piece action housing 40 is rotated about pivot pin 32 from an at rest position (FIG. 2) to an open, cocking position (FIG. 4), the lateral offset between pivot pin 32 and plunger stop pin 34 causes cocking plunger assembly 50 to move striker assembly 60 rearwardly and uncovers primer adapter 24 providing access thereto.

Figure 3:
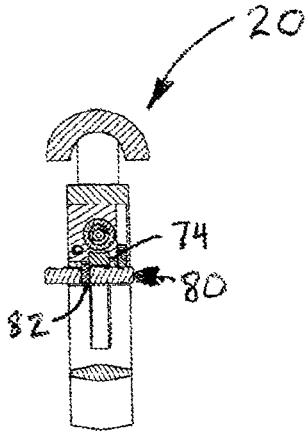
FIG. 3 is a cross-sectional end view as seen along line 3-3 of FIG. 1.

A peripheral groove 63 (FIG. 7) is formed in the surface of striker element 62 which receives upwardly extending projection 72 on pivoting sear link 74 and retaining striker assembly 60 in a rearward, cocked position. Cross bolt safety member 80 has an adjustment screw 82 threadingly engaged therein which is at least partially positionable beneath pivoting sear link 74 (FIG. 6) to inhibit its downward movement thereby preventing reciprocal movement of striker assembly 60. The "safety off" position is depicted in FIG. 3 in which screw 82 is offset from sear link 74.

Trigger assembly 90 (FIGS. 5, 7) includes: a) J-shaped trigger element 92; b) pivot pin 93 securing trigger element 92 to one-piece action housing 40; c) trigger force plunger 96 engaging upper arm 94 of J-shaped trigger element 92; d) spring 95 exerting a downward pressure on trigger force plunger 96; e) adjustable set screw 98 engaging an upper portion of spring 95 facilitating simple adjustment of the downward pressure on trigger force plunger 96. Transfer pin 84 extends between forward end 91 of trigger element 92 and rear end 75 of pivoting sear link 74 (FIG. 7), such that when trigger element 92 pivots about pivot pin 93, transfer pin 84 causes pivoting sear link 74 to rotate downwardly disengaging upwardly extending projection 72 from groove 63 allowing main spring assembly 70 to propel striker assembly 60 forward.

Figure 8:
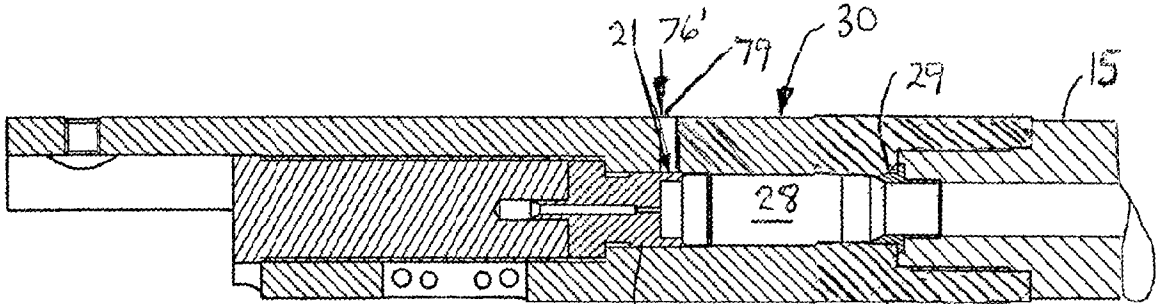
FIG. 8 is a cross-sectional detail of the barrel breech showing an alternative pressure relief system.

Breech plug 26 (FIG. 4) into which primer adapter 24 extends, is positioned in barrel breech 30. Removable orifice seal module 27 is inserted into barrel breech 30 immediately downstream of breech plug 26 defining a first end of a powder chamber 28 of barrel breech 30. Replaceable throat bushing 29 is positioned at a second opposite end of powder chamber 28. Most preferably, the replaceable throat bushing is situated at the juncture of barrel breech 30 and the barrel 15 (FIG. 8) to permit easy access when change is warranted. Over-pressure vent means 76 is provided in the powder chamber 28 to prevent damage to the barrel breech due to an incorrect or excessively large powder charge, double load, ramrod obstruction, or the like. In the FIG. 2 embodiment, over-pressure vent means 76 comprises a thin-flanged plug 77 which is supported by a hollow set screw 78 threadably inserted into a wall portion of the barrel breech 30. In the FIG. 8 embodiment, over-pressure vent means 76' includes vent hole 79 in the barrel breech 30 and thin wall portion 21 of orifice seal module 27 which covers vent hole 79. In either embodiment, thin-flanged 77 or thin-walled element 21 will rupture permitting the excess gas pressure to escape through a vent rather than damaging the barrel breech 30 or the rifle barrel 15.

Figures 4, 6, 7:
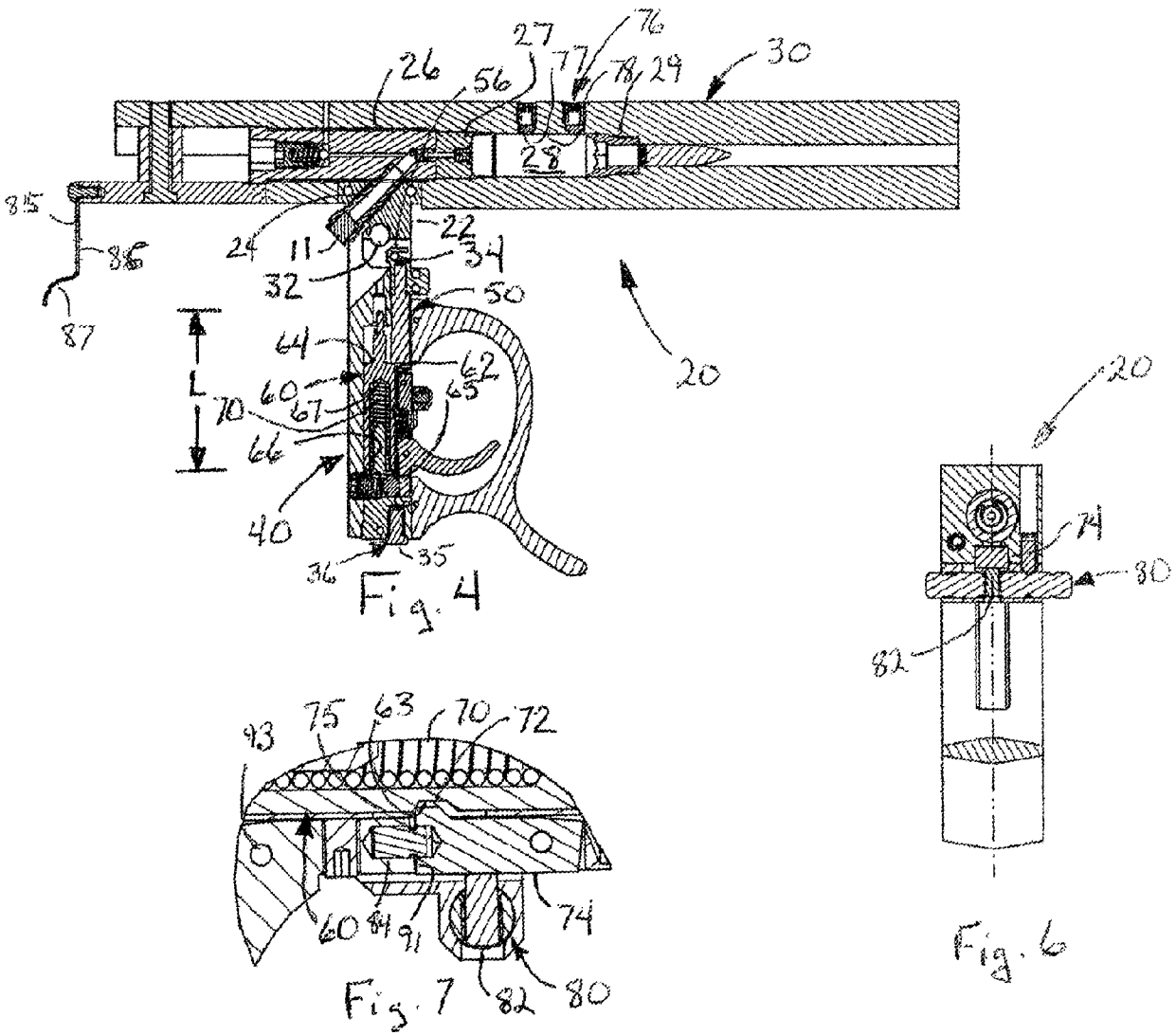
FIG. 4 is a cross-sectional side view of the first embodiment with the action breech assembly pivoted to cocking position.
FIG. 6 is a cross-sectional end view as seen along line 6-6 in FIG. 5.
FIG. 7 is a cross-sectional detail view as enlarged from circle B of FIG. 5.
Figure 5:
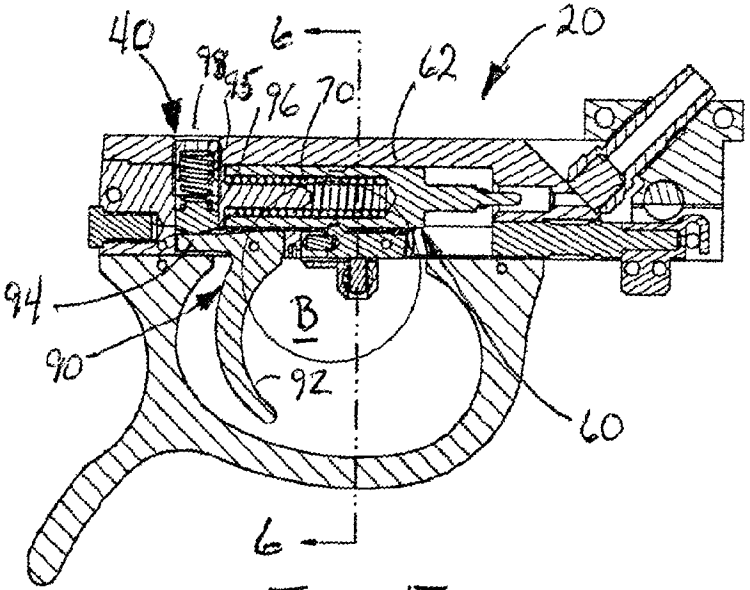
FIG. 5 is a cross-sectional side view of the first embodiment with the action breech assembly in cocked position.

Leaf spring 85 (FIG. 4) is attached to a rear portion of barrel breech 30 and extends downwardly to engage a rear portion of one-piece action housing 40 in its at rest position (FIG. 2). Leaf spring 85 has a hole 86 therein which engages over head 35 of screw 36 which is threaded into action plug 47. Leaf spring 85 has an arcuate extension 87 which is finger engageable to release screwhead 35 allowing one-piece action housing 40 to move to the open, cocked position (FIG. 4).

Figure 9A:
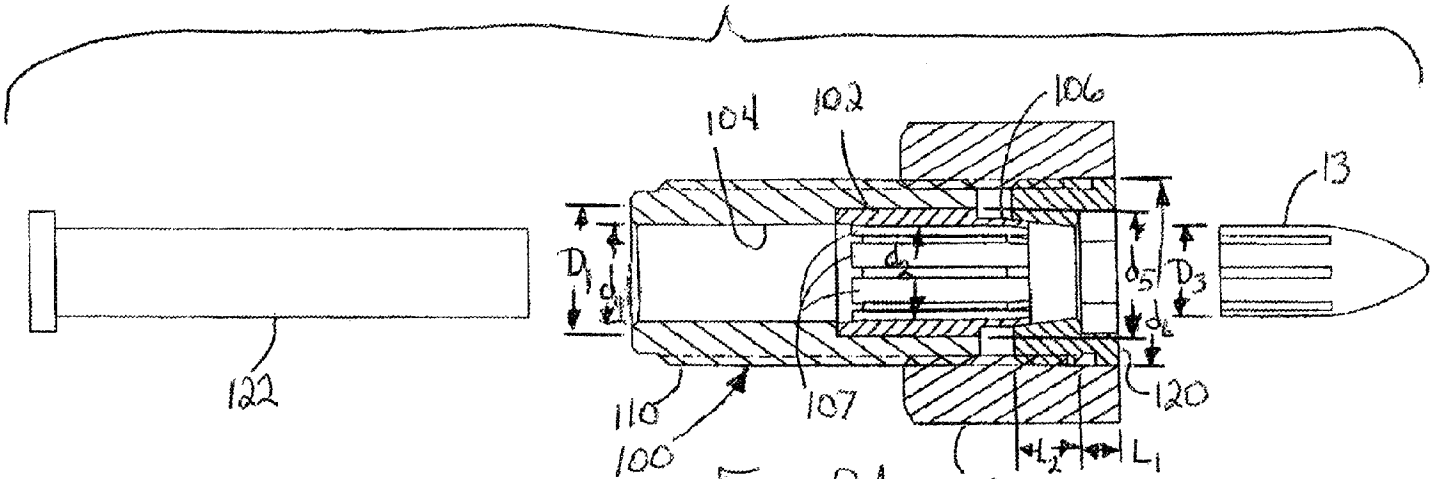
FIG. 9A is side view in partial cross section of a sizing die assembly for shaping and sizing a bullet; and, FIG. 9B is an end view of the sizing die assembly shown in FIG. 9A.
Figure 9B:
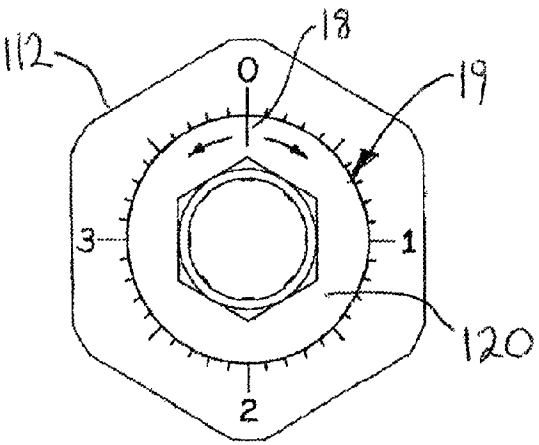

A further feature of the present invention is the provision of an adjustable sizing die assembly 100 (FIGS. 9A & 9B) for shaping bullet 13. Sizing die assembly 100 includes a cylindrical steel sizing die 102 preferably made of the same steel as rifle barrel 15 and has a first external diameter $D_1$ and a through bore 104 with an internal diameter $d_2$ generally equivalent to an external diameter $D_3$ of bullet 13. Forward end of sizing die 102 has a first thin-walled tapering portion 106 formed thereon. Entrance sleeve 110 has a first internal diameter $d_4$ equivalent to first external diameter $D_3$ of bullet 13 and a second internal diameter $d_5$ larger than first internal diameter $d_4$ which is generally equal to the external diameter $D_1$ of sizing die 102. Female compression collar 120 has a first length $L_1$ having an internal hex diameter, a second length $L_2$ having an internal taper configured to receive first thin-walled tapering portion 106, and an external thread which mates with the thread in internal diameter $d_6$ of external sleeve 112. Reference mark 18 on compression collar aligns with indicia 19 on the face of external sleeve 112 to allow a specific amount of adjustment to the external diameter of bullet 13. By way of example and not limitation, the rotation of reference mark one unit (i.e., from 0 to 1) results in the removal of 0.001 inch from the diameter $D_3$. When female compression collar 120 is tightened into threaded internal diameter $d_6$, second length $L_2$ having its internal taper (typically 2°), collapses first thin-walled tapering portion 106 (which has a corresponding 2° taper) to a smaller effective diameter. Preferably, the internal diameter $d_2$ of through bore 104 has rifling grooves 107 etched therein such that rifling grooves 17 are formed on bullet 13. It will be understood that the rifling grooves 17 may be omitted without departing from the scope of the invention and the sizing die 100 will still be useful for shaping the bullet 13 to the desired diameter. By tightening female compression collar 120 the amount of material displaced from the diameter of bullet 13 including the diameter of rifling grooves 17 are adjusted as bullet 13 is pushed through sizing die assembly 100 by ram rod 122 to produce proper diameter, size and shape for the particular barrel 15.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. An adjustable sizing die assembly for shaping a bullet, said sizing die assembly comprising:

a) a cylindrical steel sizing die having a first external diameter and a through bore with an internal diameter generally equivalent to an external diameter of a bullet, said cylindrical steel sizing die having a first thin-walled tapering portion formed on a first end;

b) an external sleeve having a first internal diameter equivalent to said first external diameter of said cylindrical steel sizing die and a second internal diameter larger than said first internal diameter, said second internal diameter being threaded;

c) a female compression collar having a first length with a uniform internal diameter, a second length having an internal taper configured to receive said first thin-walled tapering portion, and an external thread which mates with said second internal diameter of said external sleeve;

whereby when said female compression collar is tightened into said second internal diameter, said second length having said internal taper collapses said first thin-walled tapering portion to a smaller effective diameter.

2. The adjustable sizing die assembly of claim 1 further comprising rifling grooves etched into said internal through bore of said cylindrical sizing die whereby tightening of said female compression collar also adjusts a diameter of rifling grooves to be transferred to the external diameter of the bullet as it is pushed through said sizing die assembly.

3. The adjustable sizing die assembly of claim 1 further comprising indicia presented on a front surface of said sizing die to permit specific adjustment of said sizing die to provide a desired diameter of the bullet.

* * * * *